US005964173A

United States Patent [19]

Erskine et al.

[11] Patent Number: 5,964,173

[45] Date of Patent: Oct. 12, 1999

[54] BOAT CABIN CLOSURE THAT PIVOTS OUT THEN SLIDES

[75] Inventors: Edward J. Erskine, Benson; Nelson Kent, East Berne, both of N.Y.

[73] Assignee: N.A. Taylor Co., Inc., Del.

[21] Appl. No.: 09/017,805

[22] Filed: Feb. 3, 1998

[51] Int. Cl.[6] ..... B63B 19/00

[52] U.S. Cl. ..... 114/176; 114/201 R

[58] Field of Search ..... 114/201–203, 173–178; 49/209–211, 216; 296/155

[56] References Cited

FOREIGN PATENT DOCUMENTS 404198578 7/1992 Japan ..... 49/211

OTHER PUBLICATIONS

"Side doors 'pantograph type'" brochure, Nautica Accessori NAUTILUS, Genova, Italy (admitted prior art).

Pacific Coast Marine Industries drawing "Weathertight Overturning Door", PCM–052–B–01 (admitted prior art).

Taylor Made Systems 1998 catalog, pp. 28–32 (admitted prior art).

*Primary Examiner*—Ed Swinehart

*Attorney, Agent, or Firm*—Nixon & Vanderhye P.C.

[57] ABSTRACT

A self-contained closure and closure frame assembly are easily mounted in the cabin of a boat, requiring minimal disturbance of the boat structures. The closure requires a minimum of space during movement from a closed to a fully open position, the closure first being moved outwardly generally parallel to the cabin, by pivoted levers, to an initial open position, and then slid to a fully open position. Slide tracks are provided in the closure itself, and they cooperate with slide mechanisms pivotally connected to the closure frame. A series of levers and interlock elements insures proper and secure pivotal movement of the slide mechanisms between closed and initial opening positions, and does not allow sliding movement of the closure until it is substantially in the initial open position. Sliding movement is positively guided to substantially prevent skewing in any plane as the closure is slid open with respect to the frame.

38 Claims, 15 Drawing Sheets

BOAT CABIN CLOSURE THAT PIVOTS OUT THEN SLIDES

BACKGROUND AND SUMMARY OF THE INVENTION

In many circumstances, it is desirable to have a closure (such as a door or a window) which is easily installed, takes up a minimum of useful space as it is opened and closed, and is reliable in operation. These criteria are particularly important for closures for boat cabins since on boats space is at a premium.

While there are a large number of prior art closure mechanisms that can be used in boats or other vehicles, they typically have drawbacks associated therewith. For example, conventional sliding doors, like patio doors, have been used at the aft locations of cabins. Also, pocket doors, which comprise half a patio door mounted on the outside of the cabin wall, are sometimes used. However, these doors take up a large area, and have exposed tracks even when closed. Also, the bottom track is on the floor and exposed to debris, and the door does not have a flush appearance when closed.

Another known closure that is particularly adapted for a boat cabin is a pantograph door. The pantograph door swings out of the door frame and up against the side of the cabin on a linkage which maintains the door parallel to the side of the cabin. Pantograph doors require a significant clearance as they are swung out of the opening into the walkway. This can cause a problem on a number of boats where space is tight, and requires a closure to be positioned where it is not entirely desirable because stairways, rescue equipment, or the like may be in the way if the pantograph door is located in otherwise desirable positions.

Sliding doors for vans have not been adapted to boats, but provide a very suitable closure system for motor vehicles. In a typically van sliding door, the door slides on hinge mounted rollers which are connected to the door. The rollers engage curved tracks that are integrated into the vehicle, typically being provided at top, bottom, and central locations. This construction requires a significant amount of "momentum" when the door is being closed since the rollers move in a curved track in order to move into the locked position. These doors are difficult to modify to accommodate a boat design since they require effective integration of the tracks into the cabin and deck rather than allowing mounting of a self-contained frame and closure mechanism. Also, because volumes for boats do not approach those for vans, the design of tooling, etc., in order to modify such closures for boat use might be cost prohibitive from a practical standpoint. Also, the provisions of the tracks means that debris can collect in a lower track, and some space within the cabin is less than desirably utilized.

According to the present invention, a self-contained closure and closure frame assembly, and a mounting assembly for mounting a closure to a frame, are provided that have a number of advantages compared to the prior art constructions described above. The assemblies according to the invention are suitable for use with all types of closures, including in homes, offices, motor vehicles (particularly vans but also other vehicles), and the like. The assemblies according to the invention are particularly suitable for use with boats, however, having a number of advantages that are particularly important on boats or in other environments where space is at a premium and ease of installation and effective operation are important.

According to one aspect of the present invention a boat is provided comprising the following components: A boat hull, deck and cabin, the cabin preferably having one or more transparent panels or windshields or windows. An opening formed in the cabin. A closure for the cabin opening which fits in the opening in a closed position, and which is movable first to an initial open position and then to a final open position in which the closure is substantially clear of the opening, the closure including first and second slide tracks therein. And the closure mounted to the cabin or cabin and deck so that the closure is initially movable from the closed position outwardly from the opening to the initial open position; and then slides substantially parallel to the opening to the final open position, the closure mounted by first and second slide mechanisms for cooperating with the first and second slide tracks; and at least one lever connecting each of the slide mechanisms to the cabin or deck so that the closure is pivotal from the closed position to the initial open position.

In the preferred embodiment, each of the slide tracks comprises a linear (rack) gear, and each of the slide mechanisms comprises a rotatable gear engaging a respective linear gear; and the closure further comprises means for substantially synchronizing rotation of the rotatable gears to substantially preclude vertical skewing of the closure during sliding movement thereof. The means for synchronizing rotation of the rotatable gears may comprise any conventional structure which performs that function, and in the preferred embodiment of the invention comprises a timing belt or chain which moves within a tubular frame element (first torsion tube, which keeps the gears in alignment) and is operatively connected to both the rotatable gears, as by an accessory gear or sprocket or pulley element connected to the same shaft as the rotatable gear for each of the slide mechanisms.

The boat slide mechanisms each also preferably further comprise a low friction material slide block sliding in one of the slide tracks, and having a key or keyway, and a slide block bracket having a keyway or key cooperating with the slide block key or keyway, to substantially prevent horizontal skewing of the closure. The boat may still further comprise means for substantially preventing sliding movement of the slide tracks with respect to the slide mechanisms until the slide mechanisms are substantially in the initial open position, so that the slide mechanisms are disposed therein while the closure is moved from an initial open position to the final open position by sliding with respect to the slide mechanisms while the slide mechanisms do not slide. The means for substantially preventing may comprise any conventional structure for performing interlock function, or may comprise a particular design of interlock mechanism which provides another aspect of the present invention.

The opening preferably is a door opening, and the closure preferably comprises a door having a top, a center portion, and a bottom; and the first slide mechanism is mounted adjacent the closure bottom and the deck, and the second slide mechanism is mounted at the center portion of the door and spaced widely from the top of the door. Alternatively more than two slide mechanisms may be provided, with cooperating slide tracks in the door, provided in any suitable location in the door, even though preferably the sliding means consists essentially of two slide tracks and cooperating slide mechanisms.

In a preferred embodiment, the at least one lever for mounting the first slide mechanism comprises first and second pivoted levers each having a first and second end and a center portion, each of the first and second pivoted levers operatively pivotally connected at the first and second ends thereof, respectively, to the deck or cabin, and the slide mechanism; and a third lever pivotally connected to the center portions of the first and second levers.

The invention also preferably comprises an interlock lever and an interlock mechanism plate, the interlock mechanism plate mounted to the first slide mechanism and having a movable interlock element mounted therein, a blocking element mounted to the interlock lever for engaging a recess in the closure, and a slot formed in the interlock lever to allow movement of the movable interlock element to allow pivoting of the interlock lever. The interlock lever, interlock mechanism plate, movable interlock element, and blocking element are preferably mounted with respect to each other so that when the third lever moves to the initial open position, the interlock lever is pivoted to a position allowing movement of the blocking element out of the blocking recess by sliding the closure so that the closure is allowed to slide with respect to the slide mechanism. The interlock mechanism also further preferably comprises a hook element of the interlock lever, and wherein the third lever comprises a locking pin. The third lever, the interlock lever, and the interlock mechanism plate are mounted with respect to each other so that when the interlock lever is moved to the position withdrawing the blocking element from the blocking recess, the hook element engages the locking pin so that the first, second and third levers are retained in the initial open position while the closure slides with respect to the slide mechanisms. Preferably the at least one lever for the second slide mechanism, and the first lever operatively mounting the first slide mechanism, are connected together by a torsion element, such as a torsion tube or bar, which insures that the levers associated with the first and second slide mechanisms substantially positively pivot in unison.

According to another aspect of the present invention a selfcontained closure and closure frame assembly is provided, which is particularly suitable for situations where it is desirable to simply install the closure where desired, and where no easy re-design of the area which will surround the frame (such as a van, boat cabin, home wall, etc.) is possible. The assembly comprises: a closure frame having top and bottom frame elements, and first and second side frame elements, the top, bottom, and side frame elements defining a closure opening. [The opening and closure may both be generally quadrate, or have any other functional configuration.] A closure mounted to the closure frame and closing the closure opening in a closed position, the closure mounted to the closure frame for movement to a first initial open position in which the closure is spaced outwardly from the closure frame and substantially parallel thereto, and then to a final open position in which the closure is substantially clear of the opening as a result of sliding movement between the closure and the closure frame.

The assembly further preferably comprises first and second slide tracks therein; and the closure is mounted to the closure frame by first and second slide mechanisms for cooperating with the first and second slide tracks. At least one lever preferably connects each of the slide mechanisms to the closure frame so that the closure moves from the closed position to the initial open position as the levers pivot. The details of the mechanisms for mounting the closure, providing interlocking, or the like, preferably are as described in the detailed description of components above.

According to another aspect of the present invention, a mounting assembly for mounting a closure to a frame is provided comprising the following components: A first lever assembly comprising first and second levers each having a first and second end and a center portion, a third lever having first and second ends, and first and second mounting elements, the first and second levers each pivotally mounted at the first end thereof to the first frame element, and pivotally mounted at the second ends thereof to the second mounting element, and the third lever pivotally connected at the first and second ends thereof to the center portions of the first and second levers, respectively, to insure movement of the first and second levers together. A second lever assembly comprising a fourth lever having first and second ends, the fourth lever pivotally mounted at the first end thereof to a third mounting element, and pivotally mounted at the second end thereof to a fourth mounting element. The second and fourth mounting elements are operatively connected to a closure and the first and third mounting elements operatively connected to a frame. And a second torsion tube or bar connecting the first and fourth levers together so that the first and fourth levers pivot together about the first ends thereof.

The mounting assembly of the invention may be used for any closure, and not just for a closure which ultimately slides, or for closures in which the tracks are mounted to the lever assemblies, and slide mechanisms are mounted to the closure. The invention is applicable not just to the preferred gear slide track and slide mechanisms described above, but also may be used with conventional sliding rollers, or other conventional slide mechanisms. In the preferred embodiment, however, the second and fourth mounting elements are mounted to a closure, and particularly to the closure with internal slide tracks as described above, while the first and third mounting elements are mounted to the closure frame, preferably directly to the closure frame so an integral unity is provided, but also potentially through other structural elements (such as a deck or cabin wall) to which the frame is ultimately secured. The details of the levers and interlock elements may be as described above.

Particularly with respect to the mounting assembly aspect of the invention, it may further be provided with an interlock mechanism plate; and an interlock lever pivotally connected to the interlock mechanism plate. The preferred embodiment includes an interlock mechanism plate mounting a movable interlock element positioned to be engaged by the third lever; and the interlock lever comprises a cam slot and a blocking element, the interlock lever and the interlock mechanism plate and the third lever being mounted with respect to each other so that when the third lever moves the movable interlock element, the movable interlock element engages the cam slot and is moved to a position which allows the interlock lever to pivot so that the blocking element thereof is moved from a position operatively substantially blocking movement of the closure to a position not blocking movement of the closure.

In particular the details further include a blocking element receiving recess into which the blocking element moves when the interlock lever is pivoted by movement of the closure to move the blocking element out of engagement with the closure. Still further the details include a movable interlock element comprising a first spring pressed element disposed within a passage in the interlock mechanism plate, and a second roller portion engaging the cam slot and the interlock lever. The interlock mechanism plate preferably includes a slot therein in which a connection between the spring pressed interlock element and the roller slides during movement thereof. This aspect of the invention also includes the interlock lever having a hook element, and the third lever having a locking pin extending upwardly therefrom adjacent but spaced from the first end thereof. The hook element and third lever are positioned with respect to each other so that when the blocking element is moved out of blocking engagement with the closure, the hook element engages the locking pin so that the third lever cannot move.

It is the primary object of the present invention to provide a reliable, simple, space-saving, and otherwise advantageous self-contained closure and/or closure frame assembly, mounting assembly for mounting a closure to a frame, and boat including such a closure. This and other objects of the invention will become clear from a detailed inspection of the invention and from the appended claims.

BRIEF DESCRIPTION OF THE DRAWINGS

FIG. 3 is a top schematic view illustrating the exemplary closure assembly according to the present invention at the top slide mechanism thereof when in the closed position, while

DETAILED DESCRIPTION OF THE DRAWINGS

Figure 1:
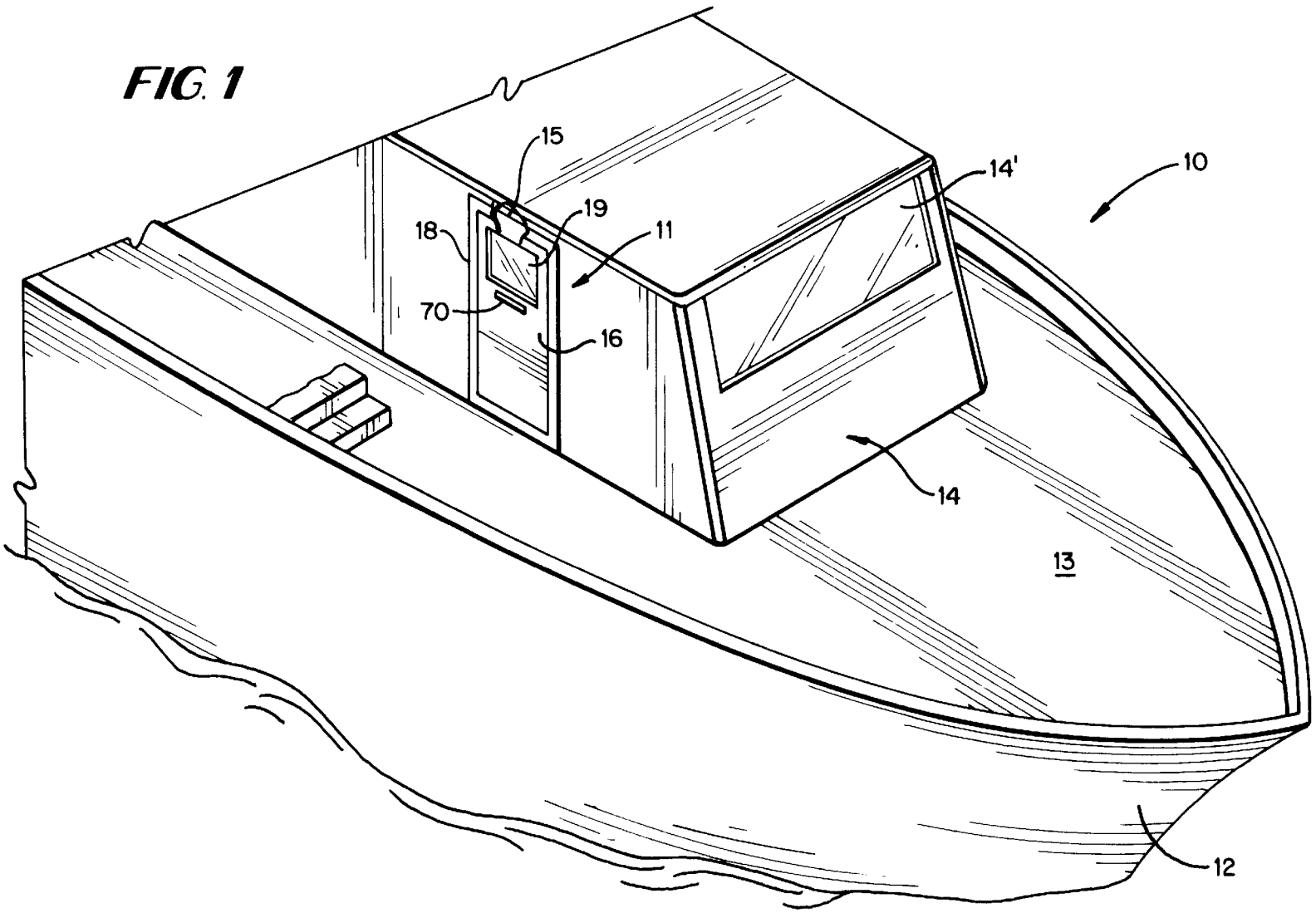
FIG. 1 is a schematic perspective view of an exemplary boat according to the present invention including therein a self-contained closure and closure assembly according to the invention.

FIG. 1 schematically illustrates a boat 10 according to the present invention having a self-contained closure, and a closure frame assembly, shown generally by reference numeral 11, therein. The boat 10 includes a boat hull 12, deck 13, and cabin 14, the cabin 14 preferably having one or more transparent panels or windshields or windows 14. An opening 15 is formed in the cabin with which the assembly 11 is associated. In particular the opening 15 is closed by a closure 16 which fits in the opening 15 in a closed position (see FIGS. 1, 3, and 5) and which is movable first to an initial open position (FIG. 7), and then to a final open position (FIG. 8) in which the closure 16 is substantially clear of the opening 15.

The closure 16 may be a door, as illustrated in the drawings, or a window, hatch, or like conventional closure.

The closure 16 is preferably self-contained with a closure frame 18 so that the assembly 11 may be shipped as an integral unit and simply installed in an appropriately dimensioned opening 15 without the need for fastening any components (such as tracks or the like) to any other structure (such as the deck 13). However, if desired the closure 16 may be separate and distinct from the frame 18, and various components may be mounted to the deck 13 as well as to the cabin 14 defining the opening 15. Preferably the frame 18 is metal, such as steel or aluminum, and the structural components of the closure 16 are also metal, although it is desirable to provide a transparent (glass or plastic) panel 19 as part of a major component for the closure 16, and perhaps to provide a decorative fiberglass or like material panel 20 (see FIG. 2). Typically an elastomeric material gasket (seal) 21 (see FIGS. 3 through 8) of conventional construction is provided between the closure 16 and the frame 18.

Figure 7:
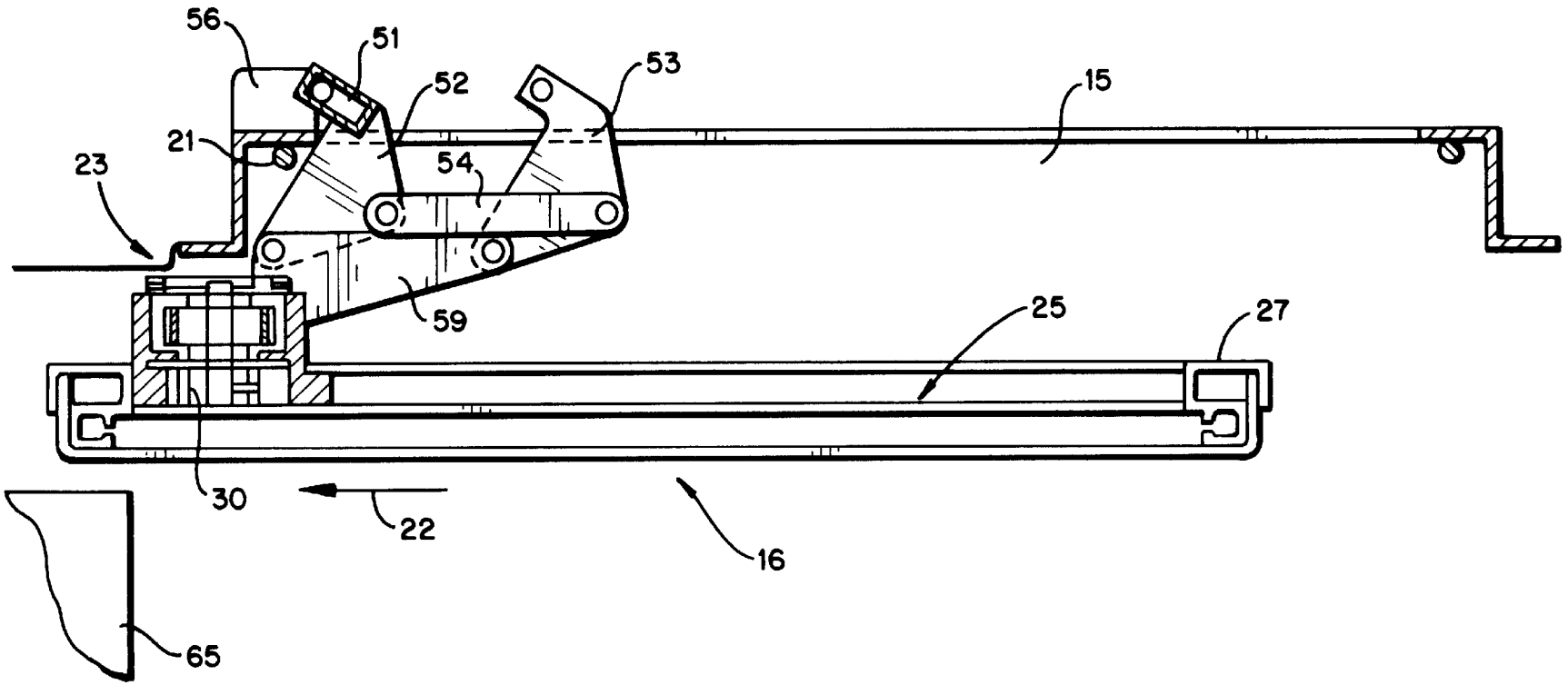
Figure 8:
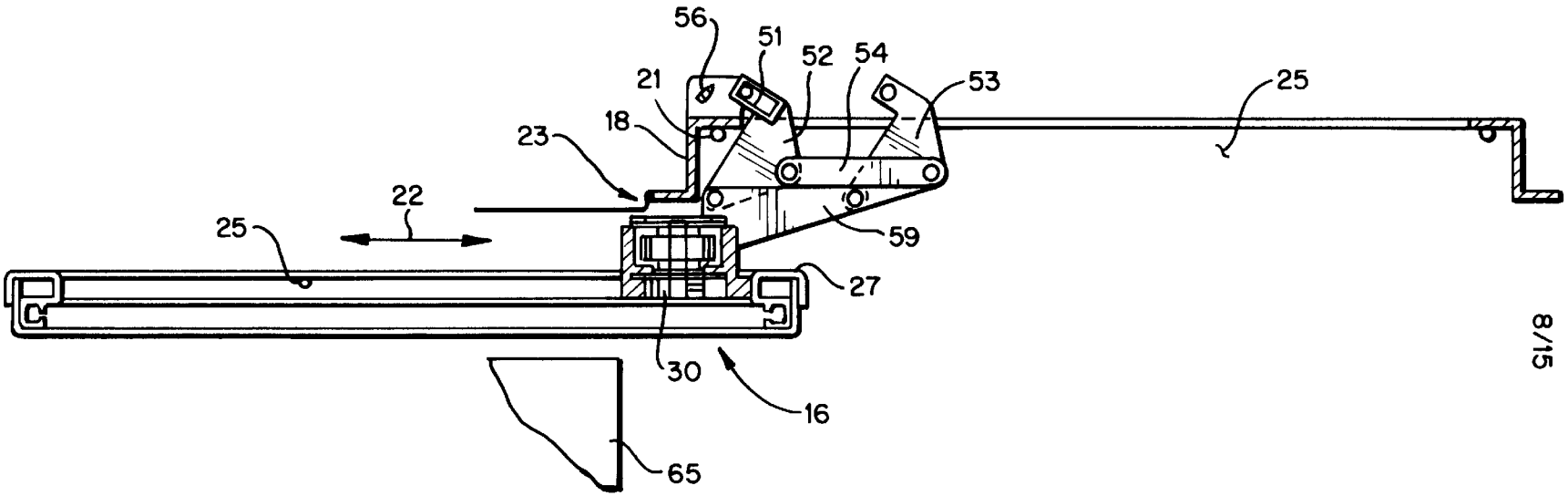
Figure 10:
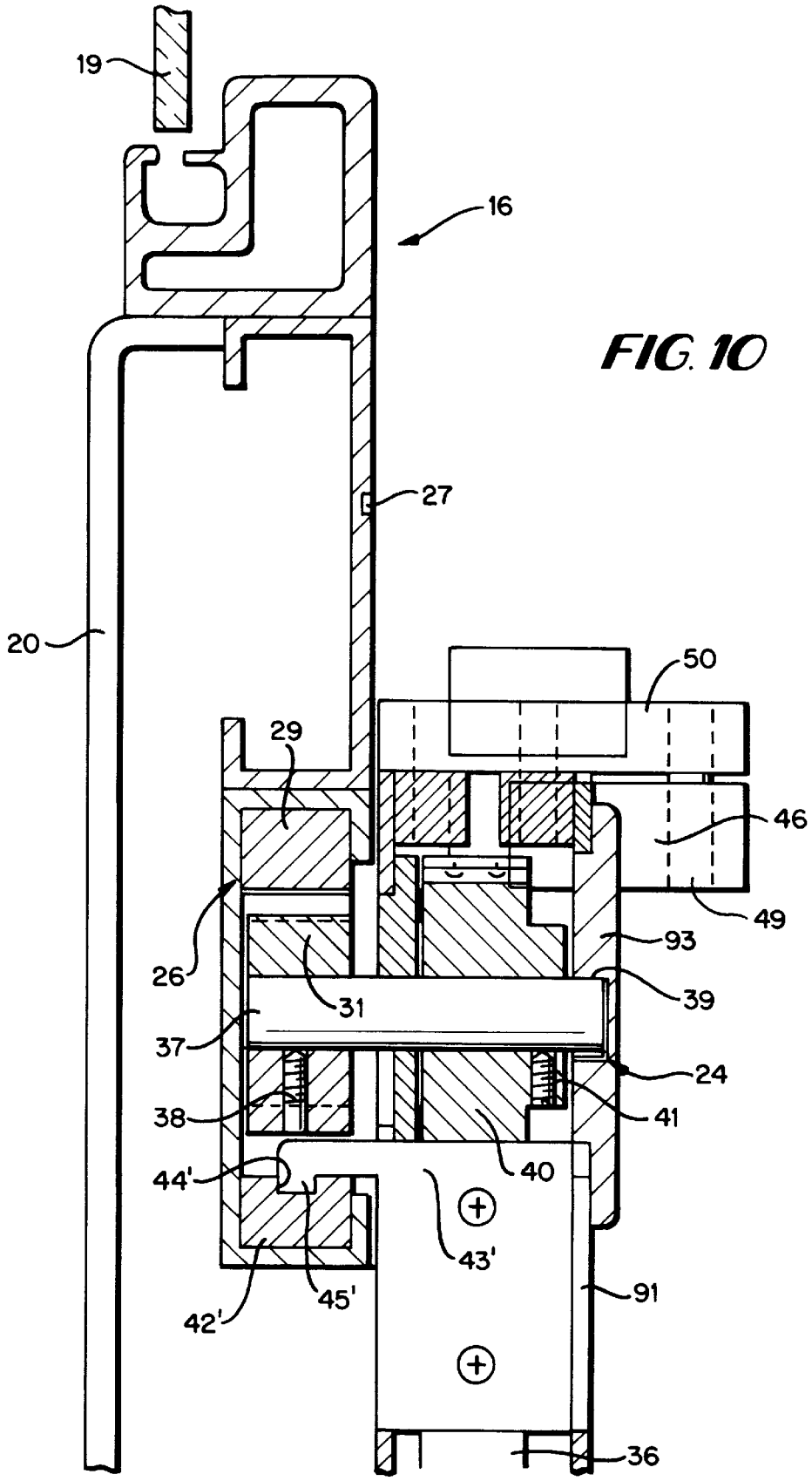
FIG. 10 is a view like that of FIG. 9 only for the upper slide track and slide mechanism.
Figure 11:
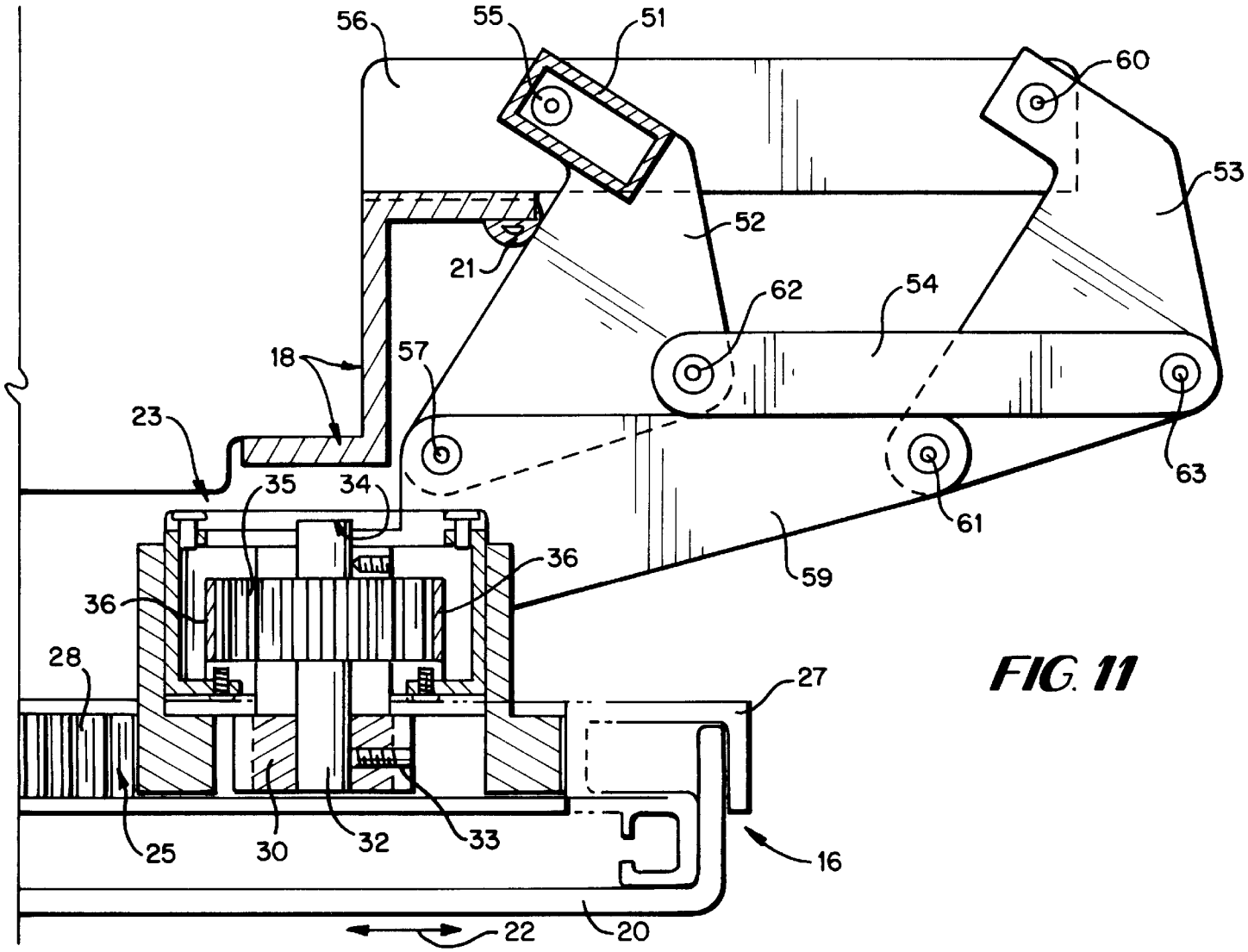
FIG. 11 is detailed top view, partly in elevation and partly in cross section, showing the entire bottom pivot and slide mechanism, but like FIGS. 2 through 10 not showing the interlock assembly for clarity of illustration.

The closure 16 is mounted to the cabin 14 (or to the cabin 14 and deck 13) so that the closure 16 is initially movable from the closed position outwardly from the opening 15 to the initial open position (FIG. 7), and then slides (as indicated by the arrows 22 in FIGS. 4, 7, 8, and 11) substantially parallel to the opening 15 to the final opening position (FIGS. 8 and 11). The closure 16 is mounted by (at least) first and second slide mechanisms, shown schematically at 23 (see FIGS. 2, 5 through 9, and 11) and 24 (see FIGS. 2 through 4 and 10), respectively, for cooperating with slide tracks in the closure 16. The first slide track 25, for cooperating with the slide mechanism 23, is seen either schematically or in detail in FIGS. 2, 5 through 9, and 11, while the second slide track 26 is seen either in detail or schematically in FIGS. 2 through 4 and 10.

The closure 16 includes a preferably metal frame 27 which mounts the panels 19, 20 and securely holds the slide tracks 25, 26 in place. The slide tracks 25, 26 may have a wide variety of constructions. For example, they may comprise channel shaped elements for receipt of conventional sliding rollers, or low friction blocks, and may have any desired cross sectional configuration to accommodate the slide mechanisms 23, 24. However, in the preferred embodiment illustrated in the drawings in order to provide the most secure, guided, movement of the closure 16 with respect to the slide mechanisms 23, 24, each slide track 25, 26 comprises a linear rack (gear), a rack gear 28 forming the slide 25 being most clearly visible in FIGS. 2, 9, and 11, and a rack gear 29 associated with the slide track 26 being seen most clearly in FIGS. 2 and 10.

While the slide mechanisms 23, 24 may also comprise a wide variety of structures—such as conventional rollers, slide blocks, etc.—in the preferred embodiment where the rack gears 28, 29 are provided the slide mechanisms 23, 24 preferably comprise rolling (generally circular configuration) gears 30 (see FIGS. 2, 5 through 9 and 11)

and 31 (see FIGS. 2 through 4 and 10), respectively. The gears 30, 31 have gear teeth which cooperate with the gear teeth of the racks 28, 29, respectively to provided guided, secured, sliding movement of the closure 16 in the dimension 22.

Figure 9:
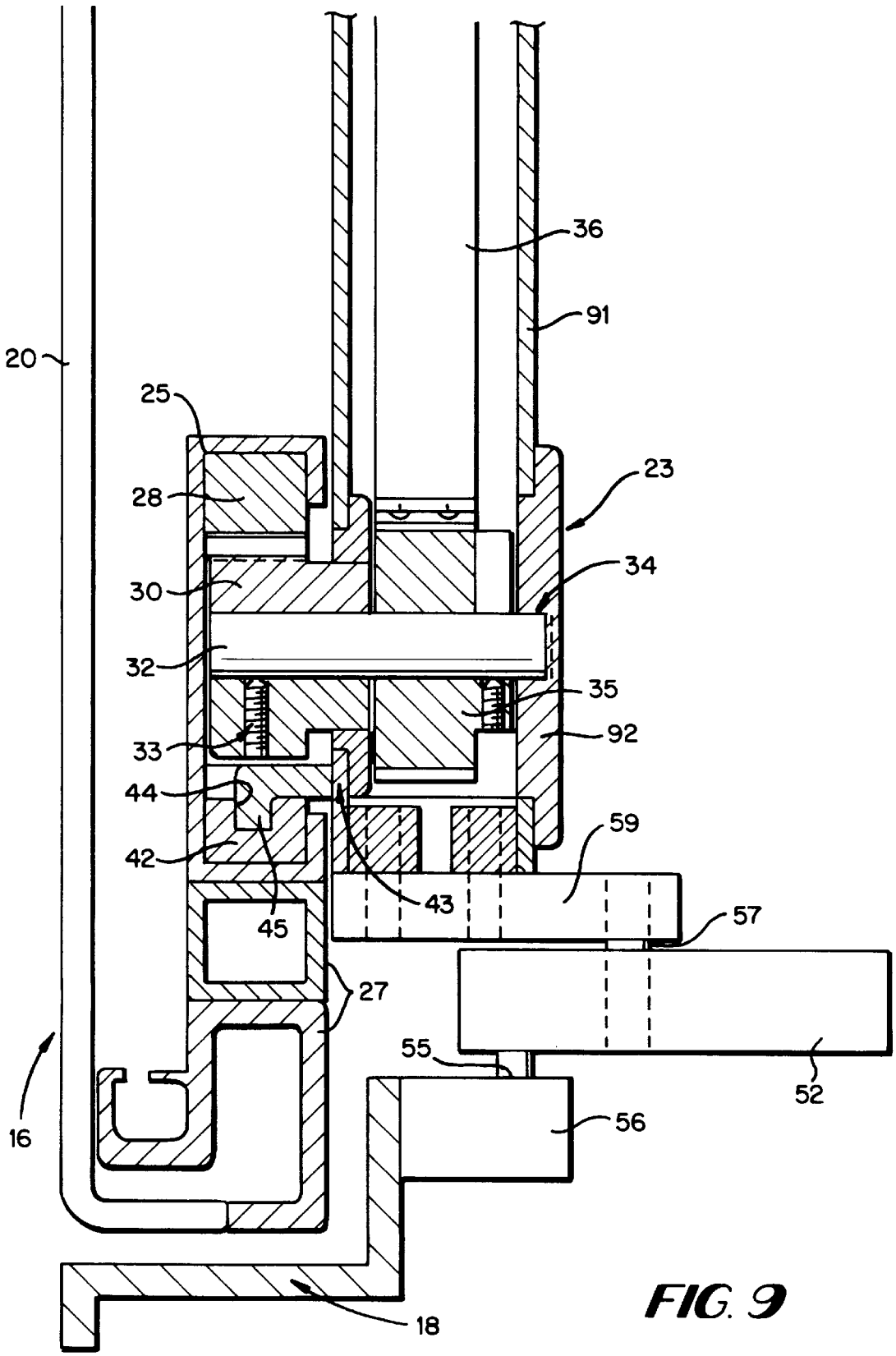
FIG. 9 is a detail view, primarily in cross section but partly in elevation, showing the bottom slide track for the closure and the bottom slide mechanism, for the closure assembly of FIGS. 2 THROUGH 8.

In the preferred embodiment, in order to prevent skewing of the closure 16 during movement in the dimension 22, it is desirable to provide means for substantially synchronizing rotation of the rotatable gears 30, 31 with respect to each other. While any conventional mechanism that is capable of preventing such skewing, depending upon the nature of the slide mechanisms 23, 24 and tracks 25, 26, may be provided, in the preferred embodiment anti-skewing is provided by a timing chain or belt and associated gears. For example, as illustrated in FIG. 9, the rotatable gear 30 is mounted on a shaft 32 by a conventional mounting screw 33 and by a conventional key and keyway (not shown), the shaft being received within a portion of the frame 27 which provides a bearing, shown schematically at 34, with other bearings also utilized as necessary. Connected to the other end of the shaft 32 is another rotatable pulley, gear, or sprocket 35 which cooperates with an endless conventional timing belt or chain 36.

As seen in FIG. 10, the rotatable gear 31 is mounted on a shaft 37 by a conventional screw 38 and by a conventional key and keyway (not shown) or the like, the shaft 37 receiving one or more bearings 39, with another pulley, gear, or sprocket 40 (e.g. held on with the screw 41) cooperating with the timing belt or chain 36. Thus, in the preferred embodiment the anti-skewing means comprises the pulleys, gears, or sprockets 35, 40, and belt or chain 36, as well as associated shafts 32, 37, bearings 34, 39, and the like, and torsion tube 91 (hereafter described). The anti-skewing means insures that when the gear 30 is rotating and allowing the track 35 to move linearly (slide) with respect to the sliding mechanism 23, that the gear 31 is rotating exactly the same amount so that the track 26 is sliding in the same way as the track 25. The gears 30, 31 are identical in size and number of teeth (as are the linear rack gears 28, 29), and the pulleys, gears, or sprockets 35, 40 are also identical in size and/or number of teeth, cooperating with like sized teeth (if applicable) on the timing belt or chain 36.

The belt or chain 36 and sprockets, etc. 35, 40 are mounted in a first torsion tube 91 which ensures that the elements 35, 40 are never skewed with respect to each other. The tube 91 may include bearing plates 92, 93 for mounting the shafts 32, 37, respectively.

Figure 17:
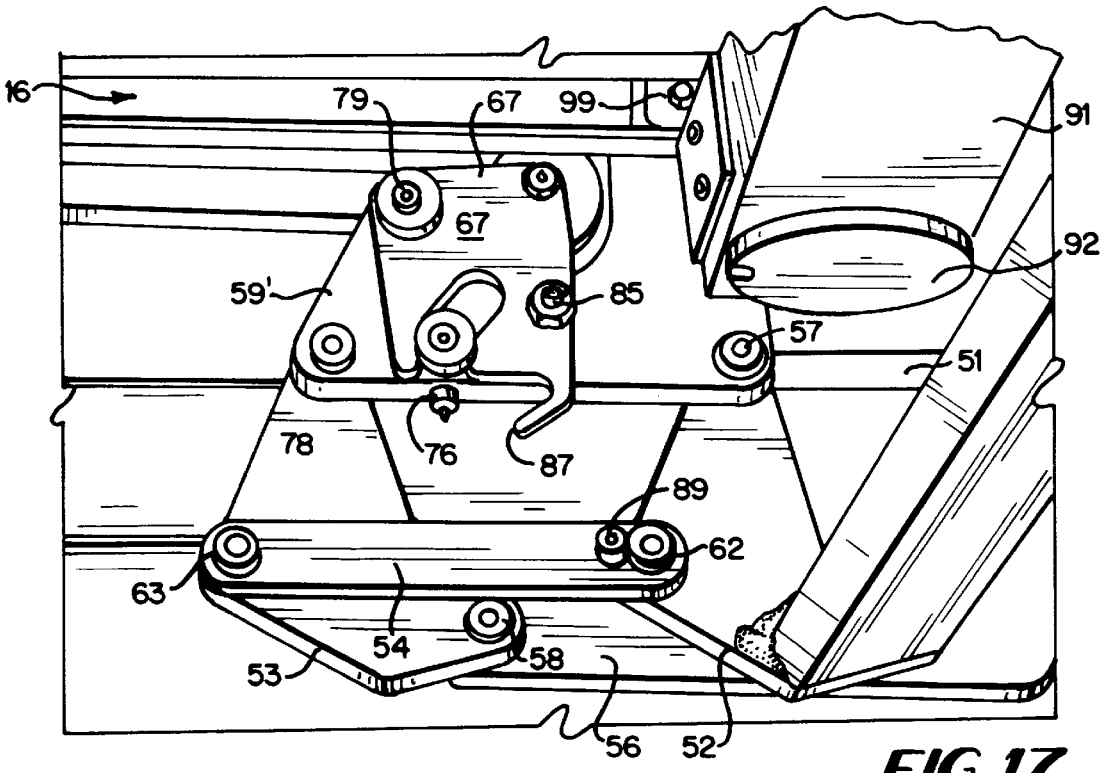
FIG. 17 is a top perspective view showing the lever components of FIG. 11 but with the interlock elements of FIGS. 12 through 16 associated therewith when the closure is intermediate the closed position and the initial open position.

In order to prevent skewing in another dimension, further antiskewing mechanisms are provided as illustrated in FIGS. 9 and 10, and associated with the slide tracks 25, 26, respectively. As seen in the exemplary embodiment in FIG. 9, a low friction material (e.g. polytetrafluoroethylene) slide block 42 is mounted in the slide channel 25 extending a small portion of the length thereof, and cooperating with a slide block bracket 43. The block 42 and bracket 43 have at least one cooperating key and keyway. While a key or keyway may be formed in either (or both) of the elements 42, 43, in the exemplary embodiment illustrated in the drawings, a keyway 44 is formed in the block 42 while a key 45 extends outwardly from the bracket 43. The bracket 43 is mounted to the torsion tube 91, which in turn is connected to the shaft 32, or otherwise fixed to the slide mechanisms so that the elements 43, 42 do not slide with respect to each other but slide with respect to the slide channel 25 as the closure 16 moves in the dimension 22. The bracket 43 may be metal or the like (e.g. reinforced nylon), as is the key portion 45 of the bracket 43; and other mechanisms, such as fasteners (see FIG. 10 for bracket 43'; and see the fastener 99 in FIGS. 17 and 18 which holds the elements 42, 43 together) may also be used to hold the block 42 in place. Also, the block end faces in the dimension 22 may comprise stops, cooperating with surfaces on closure 16 to limit the sliding movement of the closure 16.

The slide track 26 (see FIG. 10) preferably has a substantially identical mechanism for substantially preventing horizontal skewing of the closure 16. That is the slide track 26 includes a Teflon® block 42' with keyway 44' therein cooperating with a slide block bracket 43'(attached to torsion tube 91) having a key 45' associated therewith, the block 42' sliding in track 26 and providing the same positioning of stops as the block 42.

At least one lever connects each of the slide mechanisms 23, 24 to the cabin 14 (preferably through the self-contained frame 18), or the deck 13, so that the closure slide mechanisms 23, 24 are pivotal from the closed position (FIGS. 3 and 5) to the initial open position (FIGS. 4 and 7), the closure 16 being substantially parallel to the frame 18 during this movement. In the exemplary embodiment illustrated—as seen most clearly in FIGS. 3 through 11, 17, and 18—a single lever is mounted in association with the upper, second, slide mechanism 24, while a multiple lever system, which maintains the closure 16 substantially parallel to the cabin 14 during outward movement from the FIGS. 5 to 6 positions, is mounted with the bottom, first slide mechanism 23.

Figure 3:
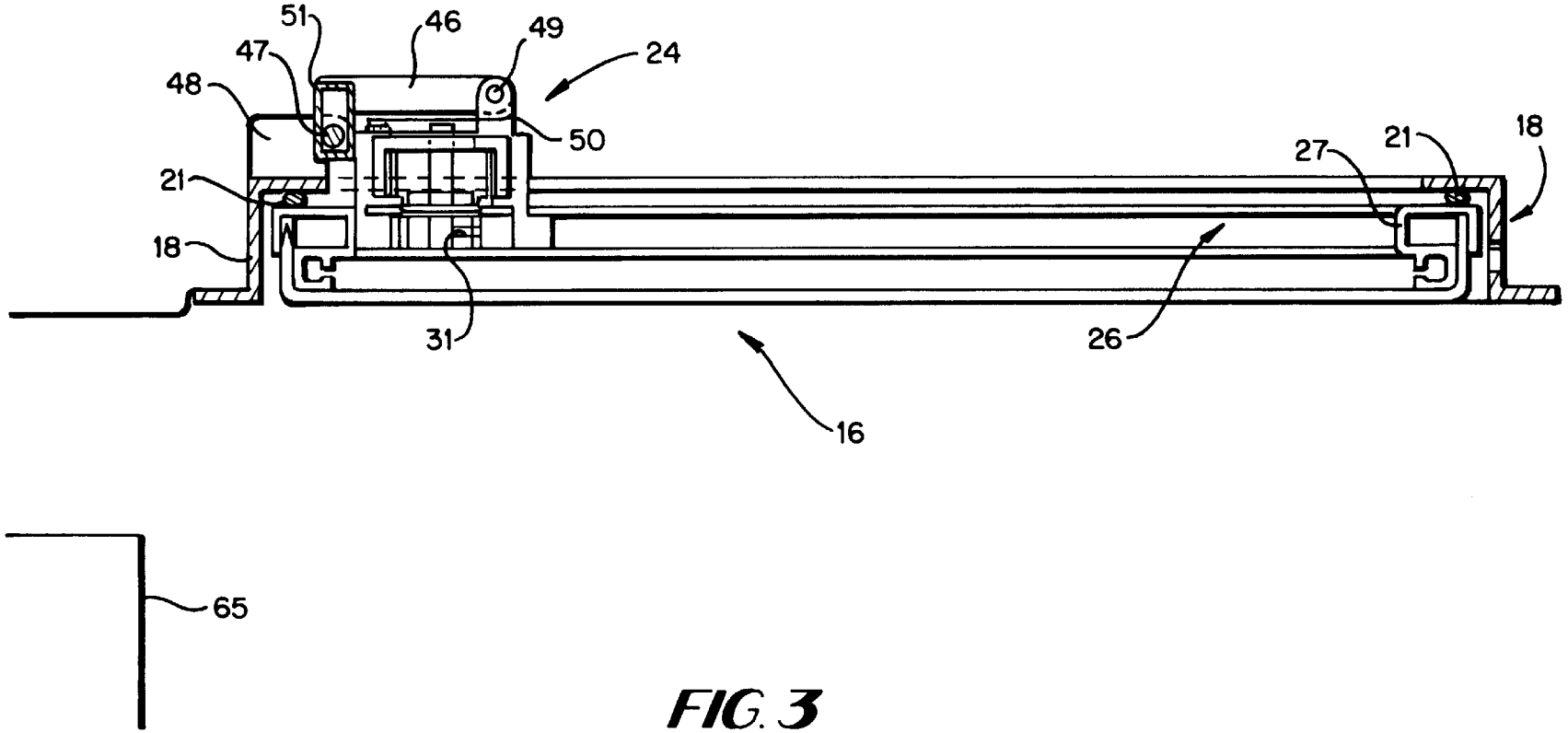
Figure 4:
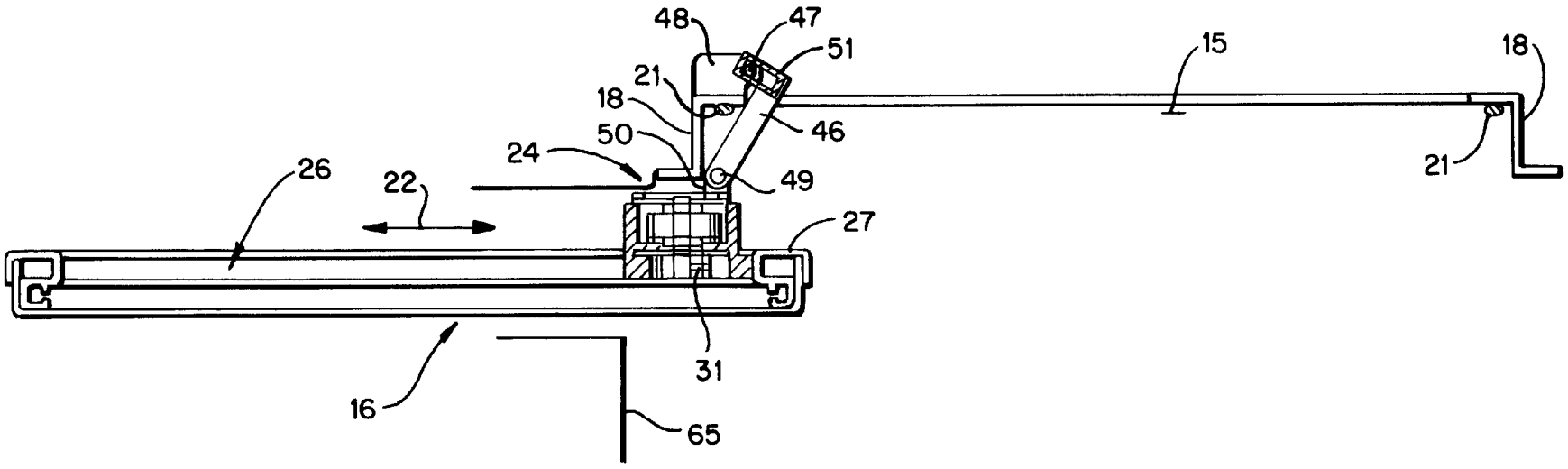
FIG. 4 is a view like that of FIG. 3 only showing the closure in the fully open position.

As seen in FIGS. 3, 4 and 10, the second slide mechanism 24 is mounted by a lever 46 (hereinafter referred to, for convenience, as the "fourth" lever). Other levers, in order to provide more positive pivotal motion, can also be used if the closure 16 is particularly heavy, or where desired, but under normal circumstances (especially for a door closure for a cabin 14) a single fourth lever 46 is provided. The fourth lever 46 is pivotally mounted at a first end 47 thereof to a mounting element 48 which is part of the frame 18. The pivotal connection for the lever 46, 47 (and for all of the rest of the levers hereinafter described) is any conventional suitable pivot pin or the like. At the second end of the lever 46 it is pivotally mounted, as indicated at 49 in FIGS. 3, 4, and 10, to the plate 50 which extends outwardly from the upper slide mechanism 24.

Connected to the lever 46 adjacent the first pivoted end 47 thereof there preferably is a second torsion tube or bar 51. The second torsion tube or bar 51, or like mechanism, is provided in order to insure pivotal movement of the lever 46 with the mounting levers for the slide mechanism 23, as will be hereinafter described.

The mounting mechanism for the lower, first, slide mechanism 23 is seen in FIGS. 5 through 9, 11, 17 and 18. This lever mounting mechanism comprises a first lever 52, a second lever 53, and a third lever 54. The first lever 52 is pivotally mounted at a first end thereof, as illustrated at 55 in the drawings, to a mounting element (a plate) 56 connected to the frame 18 in the preferred embodiment, although it can be connected to the deck 13 or other structure if a self-contained closure and frame 11 is not provided. While the plate (and various other components 56) is shown only schematically in FIGS. 5 through 8, it is shown in more detail in FIGS. 9, 11, 17, and 18.

Adjacent the pivot point 55 at the first end of the lever 52 (which may be termed a bottom hinge link), lever 52 is also connected to the vertical torsion tube or bar 51. Thus, the hinge link 52 and the lever/hinge link 46 pivot in unison about pivots 47, 55. A second end of the link 52 is pivotally connected, as schematically indicated at 57, to a plate 59 which is connected to the first slide mechanism 23. Plate 59 is shown in a simple form, without any interlock mechanism, in FIGS. 5 through 9, and 11, but may have a more complex configuration when an interlock is utilized, as indicated by the interlock mechanism plate 59' in FIGS. 12 and 13 [which takes the place of the plate 59 when an interlock mechanism is utilized in the preferred embodiment].

The lever 53, which may be referred to as a stabilizer link is pivotally connected—as indicated at 60 (see FIG. 11 in particular)—at the first end thereof to the frame plate 56, and is pivotally mounted at the second end thereof—as indicated at 61 in FIG. 11—to the slide mechanism plate 59. Both of the links 52, 53 are pivotally connected at a center portion thereof, as indicated at 62, 63, respectively in FIG. 11, to the third lever 54, which may be referred to as a redundant link. The lever 54 insures that the links 52, 53 move in unison and provides assurance that the mounting mechanism will not go past the desired initial opening position. In the initial opening position the redundant link 54 typically abuts the plate 59 to preclude further relative movement therebetween, as illustrated in FIG. 11.

Figure 5:
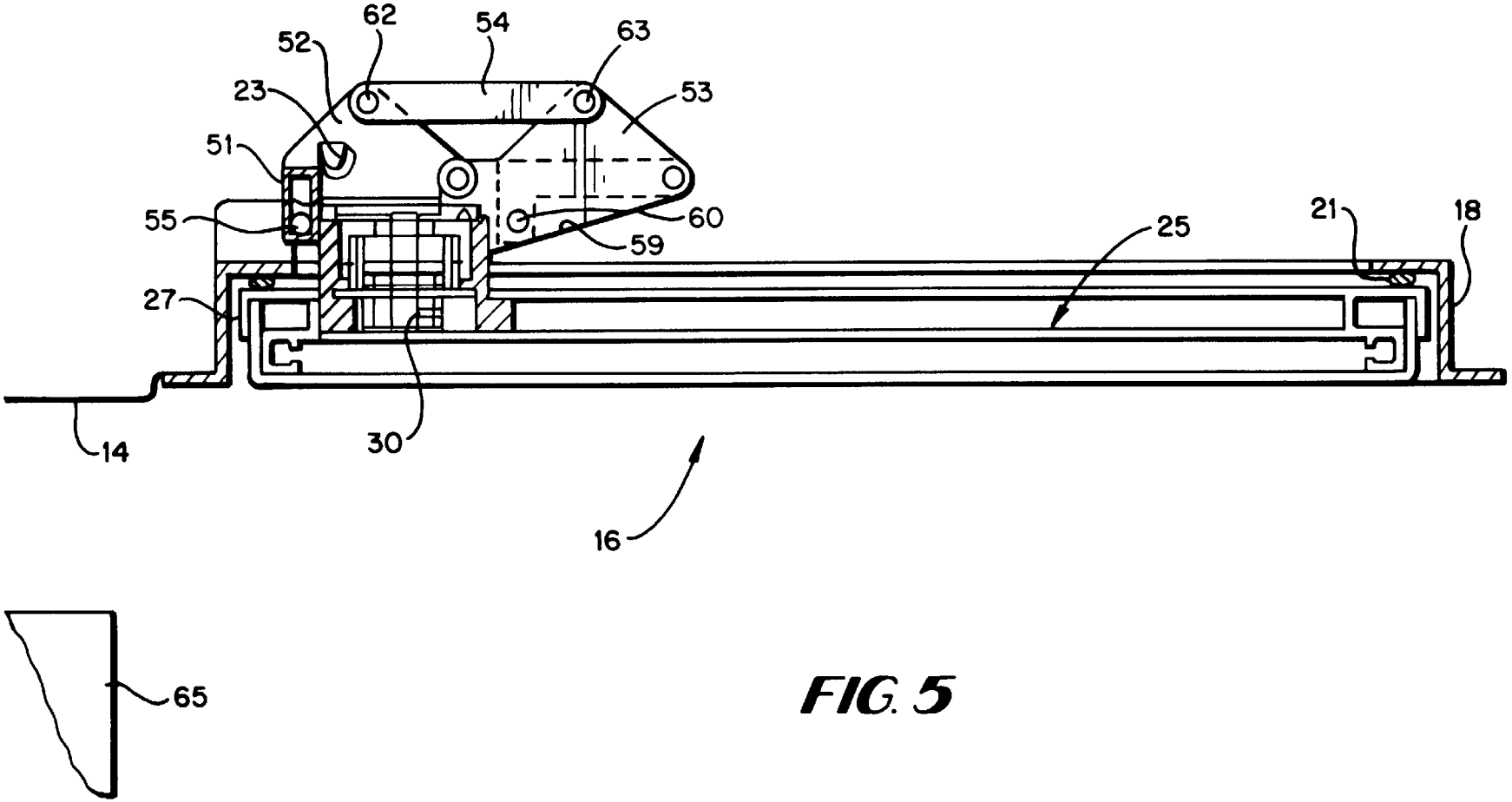
FIG. 5 is schematic view like that of FIG. 3 only for a simplified version of the lower slide mechanism when the closure is in the closed position.
Figure 6:
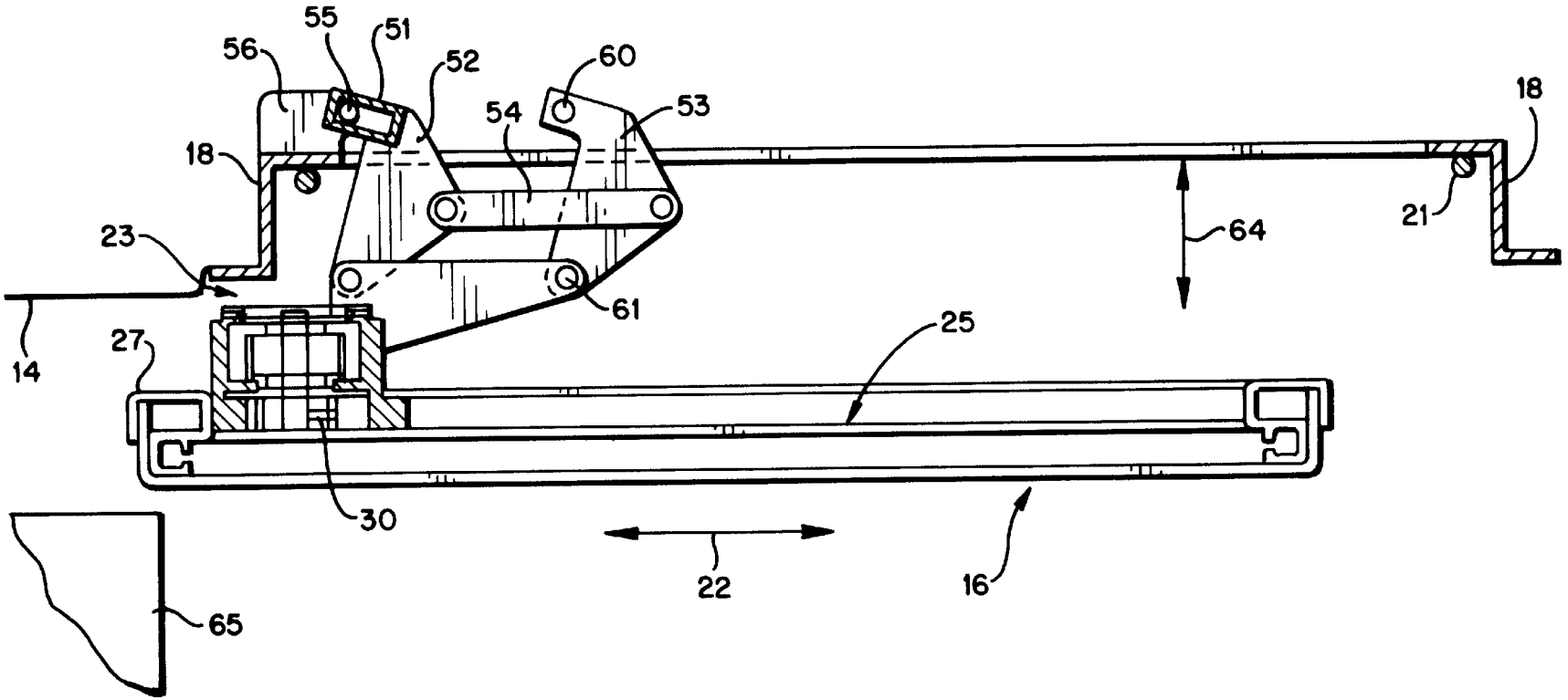
FIGS. 6, 7 and 8, respectively, are views like that of FIG. 5 only showing the assembly, respectively, in the maximum extension out, initial open position, and fully open position.

FIGS. 5 through 8 schematically illustrate the positions of the levers 52–54 as the closure 16 is opened. As illustrated in FIG. 5 where the closure 15 is closed, making a seal with the gasket 21, the closure 16 is substantially flush with the cabin 14. When the closure 16 is first opened, it moves to the maximum extension outwardly, in the dimension 64 which is substantially perpendicular to the dimension 22, and extends outwardly from the frame 18 and cabin wall 14, the position illustrated in FIG. 6. As can be seen, the maximum extension position is really only a small distance from the wall 16, so that there is as little clearance as necessary for the only "swinging" action of the closure 16. This means that the assembly 11 can be mounted in almost any location without concern for what structures are nearby. For example, as may be provided on many different boats having more than one level, a step 65 may be only a few inches from the cabin 14 yet even in the maximum extension position (FIG. 6) of the closure 16 this movement is not hindered by the step 65.

During the initial outward movement of the closure 16 as the slide mechanisms 23, 24 pivot about the links 52–54 and 46, the closure 16 moves past the maximum extension position to the full initial open position illustrated in FIGS. 7 and 4 (FIG. 7 illustrating the position before sliding of the closure 16 to the full open position). When the closure 16 is substantially in the position illustrated in FIG. 7, it may be moved to the full open position illustrated in FIGS. 4 and 8 merely by sliding the closure 16 in the dimension 22 while the slide mechanisms 23, 24 remain stationary in the dimension 22 (although various elements thereof may be rotated such as the gears 30, 31). In the fully open position illustrated in FIGS. 4 and 8, almost the entire area of volume of the opening 15 is truly open and accessible since the door frame 27 is almost even with the frame 18 in the FIGS. 4 and 8 position, since the fourth link 46 takes up only a small part of the opening 15, and since the links 52–54 are located at the bottom of opening 15 and also take up relatively little space. Also, since the tracks 25, 26 are provided in the closure 16 itself, they are typically free of debris.

Figure 2:
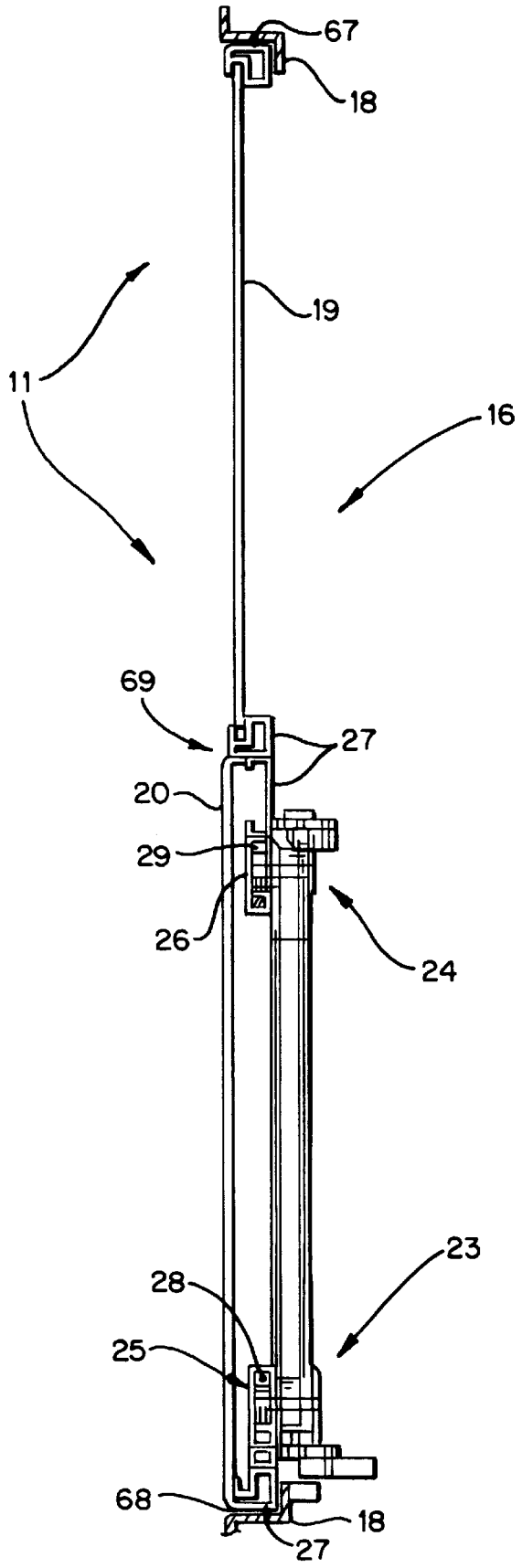
FIG. 2 is a side view, partly in cross section and partly in elevation, of an exemplary self-contained closure and closure frame assembly according to the invention.

For the embodiment illustrated in the drawings—as particularly seen in FIG. 2—the closure 16, when it comprises a door, has a top 67, a bottom 68, and a center portion 69. The first slide mechanism 23 is mounted adjacent the bottom 68, however the second slide mechanism at 27 is preferably mounted at the center portion 69, spaced widely from the top 67 (in the preferred embodiment illustrated in FIG. 2, substantially at halfway up the height of the closure 16, or below it). While this is the preferred embodiment, it will be understand that if the door 16 is particularly heavy that the slide mechanism 24 may be mounted adjacent the top 67, or an additional slide mechanism (or associated track) may be provided at the top 67. Rarely, if ever, would more than three slide mechanisms and associated tracks be necessary.

The closure 16 is moved from the closed position of FIG. 5 to the initial open position of FIG. 7 in any suitable manner or utilizing any suitable mechanisms. In the preferred embodiment, this action would be performed manually. A handle or knob, shown schematically at 70 in FIG. 1, may be provided for unlatching or unlocking the door 16 so that it can be moved. The handle 70 and the components associated therewith are not part of the present invention and may comprise any suitable conventional handle or latching mechanism, such as that conventionally utilized with pantograph type doors. Once the handle 70 is turned to unlatch the door 16 from the frame 18, the user simply pushes outwardly (or pulls outwardly) on the door 16 so that it is moved by manual power from the position illustrated in FIG. 5 through the position of FIG. 6, to the position illustrated in FIG. 7. Then the door 16 is slid in the dimension 22 by manually pushing on a side of the frame 27 thereof, or by grasping the handle 70 and moving it sidewards, so that it slides to the fully open position illustrated in FIGS. 4 and 8.

Alternatively, a power mechanism may be provided to open the door, such as a hydraulic or pneumatic cylinder that engages a suitable portion of the linkage mechanism 51–53 (or the torsion tube 51), to power the movement of the links from the position illustrated in FIG. 5 to that illustrated in FIG. 7. Also, an electric motor may be mounted in the door 16 for also powering one or both of the rotatable gears 30, 31 so that the sliding movement of the door from the position illustrated in FIG. 7 to that illustrated in FIGS. 4 and 8 may also be provided. Any suitable powering mechanisms may be utilized if desired.

In the preferred form of the invention, there preferably also are means for preventing movement of the slide tracks 25, 26 with respect to the slide mechanisms 23, 24 until the slide mechanisms 23, 24 are substantially in the initial open position (FIG. 7). While any conventional double acting interlock mechanism may be used for this purpose, in the preferred embodiment the interlock mechanism illustrated in FIGS. 12 through 18 is provided.

Figure 12:
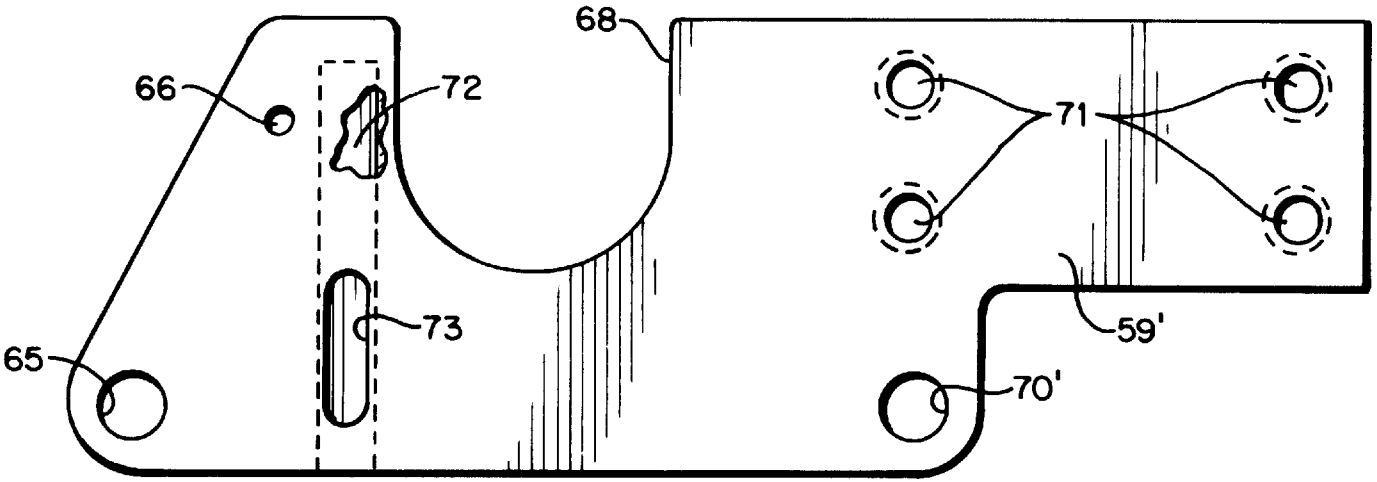
FIG. 12 is a top plan view of an interlock mechanism plate according to the present invention.
Figure 13:
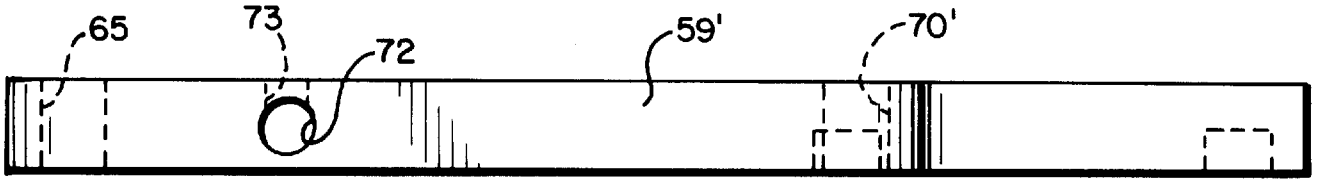
FIG. 13 is a front view of the plate of FIG. 12.
Figure 14:
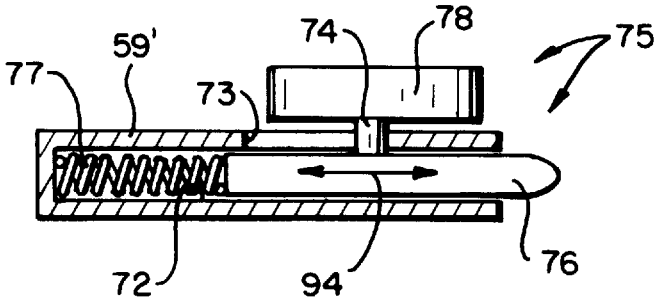
FIG. 14 is a side view, partly in cross section and partly in elevation, of the plate of FIGS. 12 and 13 with the movable interlock element shown therein.

The first component of the means for preventing sliding movement of the slide tracks 25, 26 with respect to the slide mechanism 23, 24 until the slide mechanisms 23, 24 are locked in the position of FIG. 7 (the interlock means) is the interlock mechanism plate 59' seen in FIG. 12–14, 17 and 18. The plate 59'—as seen in FIG. 12—includes a hole 65 through which the pivot pin for the pivot connection 61 extends, a hole 66 for receipt of a pivot pin for pivotally attaching the interlock lever 67 (see FIGS. 15 through 18) thereto, a cutout 68 which provides a clearance notch for a blocking element 69 (see FIGS. 15, 16, and 18) when the interlock is activated, a pivot pin receiving hole 70' for receipt of the pivot pin for the pivotal connection 57, and the plurality of fastener receiving openings 71 receiving fasteners for securing the plate 59' to the rest of the slide mechanism 23.

The plate 59' also has formed therein a bore 72 (see FIGS. 12 and 13) with an elongated slot 73 formed in the top surface of the plate 59' communicating with the bore 72 in which a shaft 74'(see FIG. 14) slides. Mounted within the bore 72 and associated with the plate 59' is a movable interlock element, shown generally by reference numeral 75 in FIG. 14. The first portion of the movable interlock element 75 comprises a plunger 76, which is spring biased by the coil spring 77 to the position illustrated in FIGS. 14 and 17. The next part of the movable interlock element 75 is the cam 78, which in the preferred embodiment illustrated in the drawings is in the form of a roller, but can take other forms. The roller 78 and plunger 76 are connected together by the shaft 74, and when the shaft 74 abuts the end of the slot 73 furthest from notch 68, the interlock mechanism is stopped in the position of FIG. 17.

Figure 16:
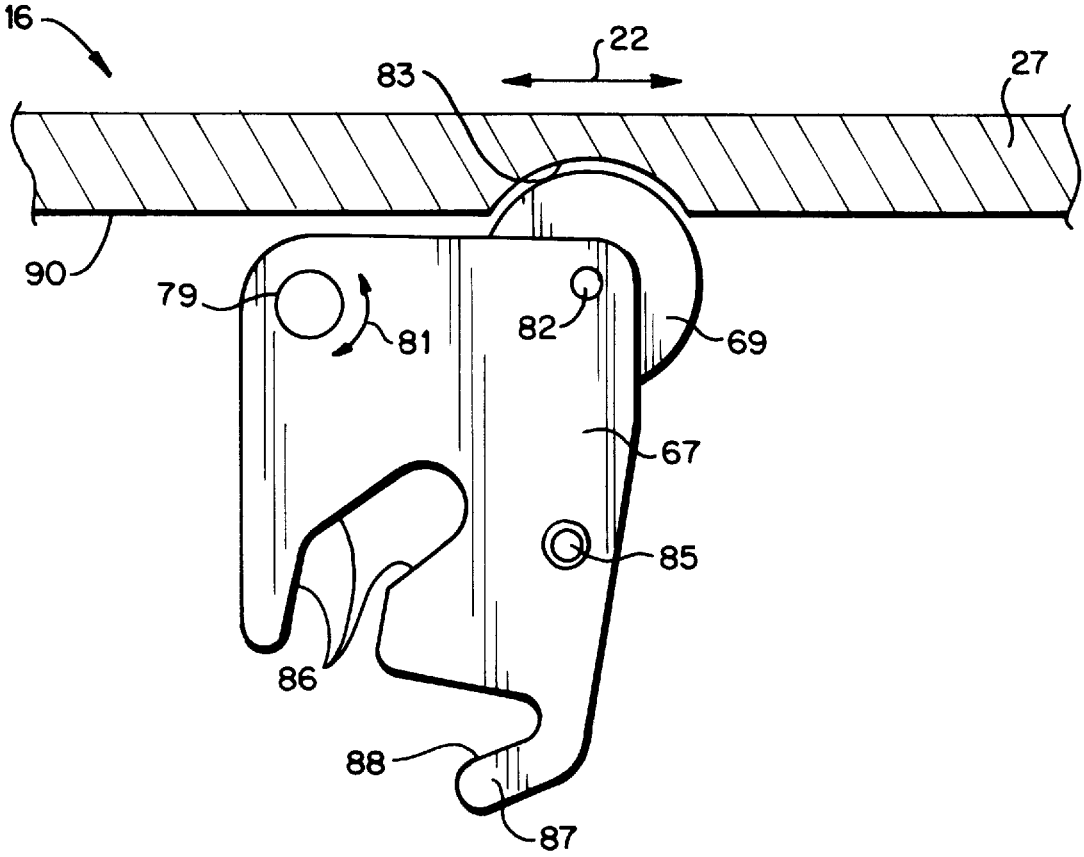
FIG. 16 is a schematic top view, partly in cross section and partly in elevation, showing how the interlock lever and blocking element of FIG. 15 cooperate with the closure to prevent sliding movement of the closure when the lever assemblies are in less than the fully open position.
Figure 15:
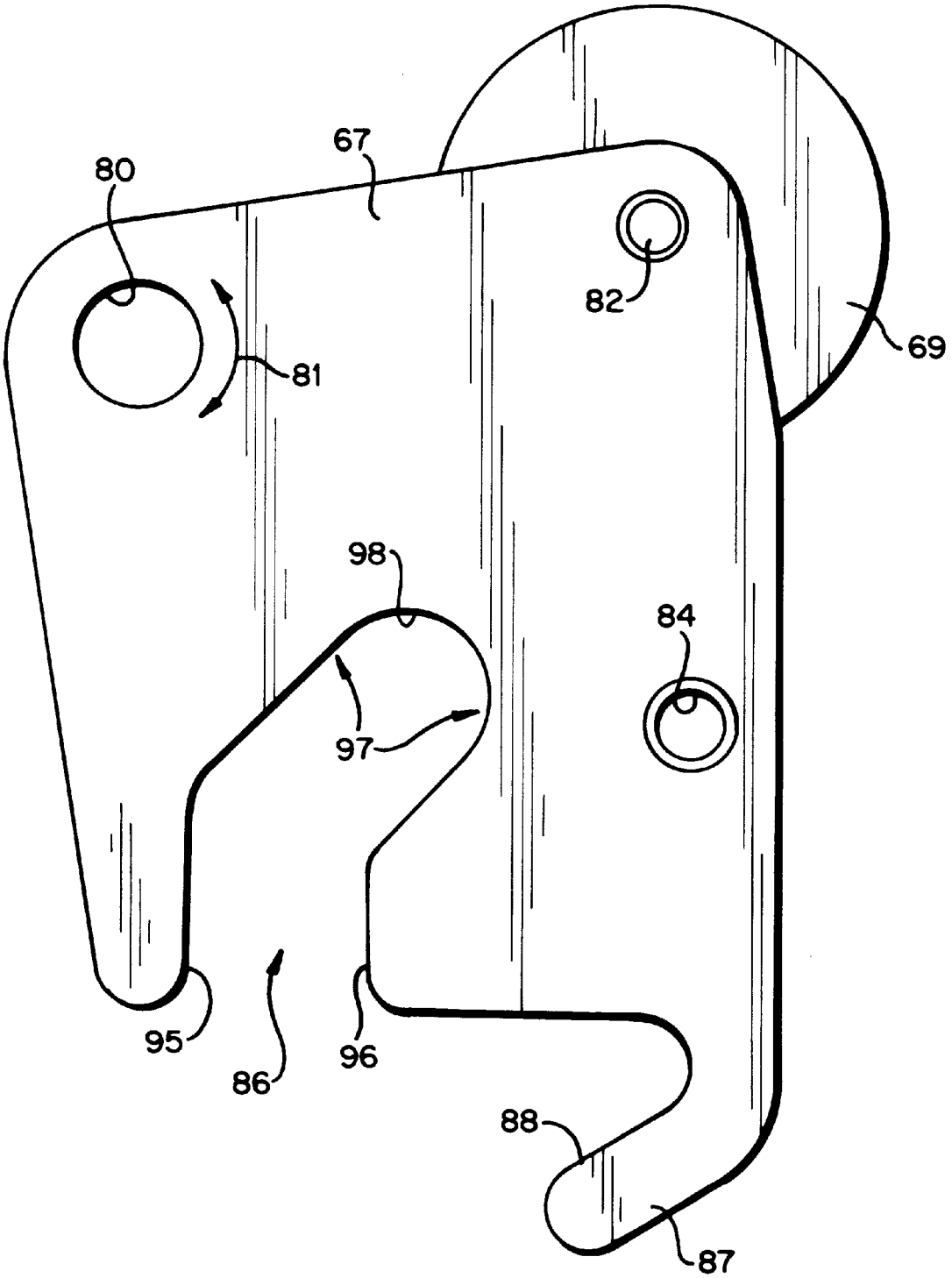
FIG. 15 is a top plan view of an interlock lever according to the invention, with the blocking element shown connected thereto.

The second major component of the interlock mechanism is the interlock lever 67 seen in FIGS. 15 through 18. A pivot pin 79 (see FIGS. 17 and 18) passes through the opening 80 in the lever 67 into the hole 66 so as to provide pivotal movement of the lever 67 with respect to the plate 59' as indicated by the arrows 81 in FIG. 15. Pivot pin 82 pivotally mounts the blocking element 69 which preferably—as illustrated in the drawings (although not necessarily)—comprises a roller. The blocking element 69 is adapted to cooperate with a like formed recess 83 (see FIG. 16) in a portion of the frame 27 of the closure 16. The particular portion of the frame 27 (which may include any extension thereof or attachment thereto) where the blocking element 69 is in the position within the recess 83 is illustrated in FIG. 16; in the FIG. 16 position the closure 16 cannot slide in the dimension 22.

The interlock lever 67 also preferably includes an opening 84 for a nylon leveling screw 85 (see FIG. 16). The screw 85 merely contacts the top of the plate 59' so as to insure that the lever 67 is substantially parallel to the plate 59' over the entire extent thereof. The screw 85 is typically of nylon or like low friction material since it slides with respect to the plate 59' as the lever 67 pivots as indicated by the arrows 81.

Figure 18:
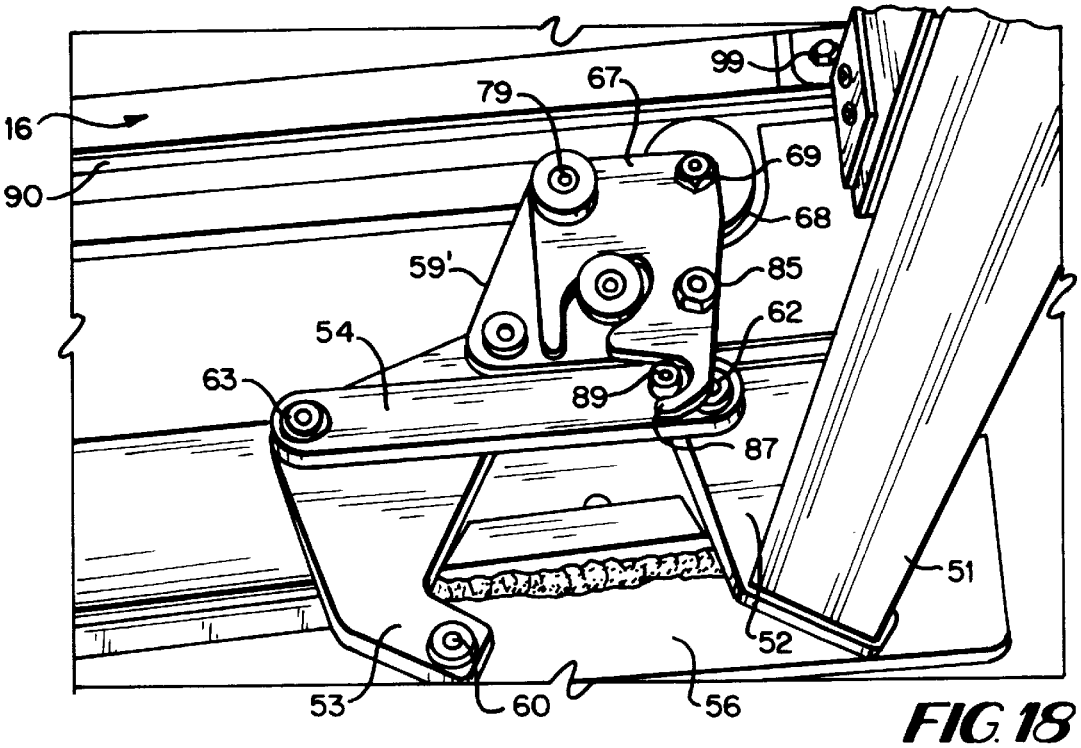
FIG. 18 is a view like that of FIG. 17 only when the closure is in the initial open position and the closure has been slid slightly to move the blocking element completely out of the blocking recess.

The interlock lever 67 also includes a cam slot 86, and a hook-shaped end 87 having an interior surface 88. The slot 86 receives the cam roller 78 therein, and movement of the cam roller 78 in the direction of the arrow 94 (see FIG. 14) causes the cam roller 78 to move deeper into the slot 86, from a position (see FIG. 17) where roller 78 is completely in the straight section (see surfaces 95, 96 in FIG. 15) to a position in which the roller 78 still engages surface 95 but is past surface 96, i.e. able to enter the slanted surface section 97 of slot 86. The plunger 76 is moved against the bias of the spring 77 when the third link 54 engages it, as seen in FIG. 18, movement of the plunger 76 effecting a like movement of the cam roller 78. When the roller 78 is in a position no longer engaging surface 96, by sliding closure 16 (e.g. by a manual push) the lever 67 is caused to pivot as indicated by arrows 81 (FIG. 15) so that the end 98 of section 97 of slot 86 moves toward the roller 78 to the position illustrated in FIG. 18. This means that the blocking element 69 is cammed out of recess 83 (FIG. 16), as seen in FIG. 18, allowing free sliding of closure 16 in dimension 22.

In order to more positively hold the third lever 54 in the position illustrated in FIG. 18 with the blocking element 69 out of the recess 83, preferably a pin 89 (see FIGS. 17 and 18) for engaging the hook element 87 extends upwardly from the third lever 54 adjacent but spaced from the pivot point 62. The surface 88 of the hook shaped element 87 actually engages the pin 89 when the entire linkage is in the position as illustrated in FIG. 18.

Once the components are in the position illustrated in FIG. 18, and the closure 16 is slid in the dimension 22 toward to the position illustrated in FIG. 8, the blocking element 69 will engage the inside surface 90 (see FIGS. 16 through 18) of the closure frame 27. This insures that the hook element 87 stays latched on the pin 89.

Operation of the interlock means is as follows: When the door 16 is in the closed position (FIGS. 3 and 5), the components have the relative positions illustrated in FIG. 17 [at which time the closure 16 cannot slide], in which the plunger 76 extends outwardly from the plate 59', and the cam roller 78 is at the bottom of the cam slot 86. As the links 52–54 and 46 pivot to the initial open position of FIG. 7, the link 54 engages the plunger 76 and depresses it against the bias of the spring 77. This simultaneously causes the cam roller 78 to be reciprocated in the dimension 91, and moved to a position where roller 78 no longer engages surface 96, as described above. Initial closure 16 sliding is then allowed, element 89 being engaged by closure 16 causing lever 67 to pivot about the pivot 79 as indicated by the arrows 81. The blocking element 69 is thus moved from the position illustrated in FIGS. 16 and 17 in which it is in the recess 83 and prevents movement of the closure 16 in the dimension 22, to the position illustrated in FIG. 18 in which it is completely free of the closure 16.

Once the components are in the position illustrated in FIG. 18, with the blocking roller 69 exterior of the recess 83, and with the hook 87 engaging the pin 89, the door 16 is free to be slid in the dimension 22. Once the door is slid so that the recess 83 clears the blocking roller 69, the blocking roller 69 engages the surface 90 of the closure 16 and thereby prevents movement of the levers 52 through 54 (and through the torsion tube 51 the lever 46) from the position illustrated in FIGS. 4, 7, 8, 11 and 18. Therefore, it is not possible to cause the closure 16 to impact the cabin 14 by pushing inwardly on the door 16. Only after the door 16 is slid back substantially to the position illustrated in FIGS. 16 and 18 and the blocking element 69 pivots back into the recess 83 are the levers 52 through 54 allowed to move back to the position illustrated in FIGS. 2, 4, and 17. During the movement of the interlock lever 67, the blocking element 69 moves into and out of the notch 68 in the plate 59'.

It will thus be seen that according to the present invention a highly advantageous mounting assembly for mounting a closure 16 to a frame 18, a self-contained closure and closure frame assembly 11, and a boat 10 including the closure 16 in the opening 15, have been provided. The invention has numerous advantages over conventional closures including a minimum of "swing" area, a minimum opportunity for the tracks to be filled with debris, positive sliding action without skewing, easy fit into any existing opening as a single unit, and a wide variety of other advantages. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A boat comprising:

a boat hull, deck and cabin;

an opening formed in said cabin;

a closure for said cabin opening which fits in said opening in a closed position, and which is movable first to an initial open position and then to a final open position in which said closure is substantially clear of said opening, said closure including first and second slide tracks therein; and said closure mounted to said cabin or cabin and deck so that said closure is initially movable from said closed position outwardly from said opening to said initial open position; and then slides substantially parallel to said opening to said final open position; said closure mounted by first and second slide mechanisms for cooperating with said first and second slide tracks; and at least one lever connecting each of said slide mechanisms to said cabin or deck so that said closure is pivotal from said closed position to said initial open position.

2. A boat as recited in claim 1 wherein each of said slide tracks comprises a linear gear, and wherein each of said slide mechanisms comprises a rotatable gear engaging a respective linear gear; and wherein said closure further comprises means for substantially synchronizing rotation of said rotatable gears to substantially preclude vertical skewing of said closure during sliding movement thereof.

3. A boat as recited in claim 2 wherein each of said slide mechanisms further comprises a low friction material slide block sliding in one of said slide tracks, and having a key or keyway, and a slide block bracket having a keyway or key cooperating with said slide block key or keyway, to substantially prevent horizontal skewing of said closure.

4. A boat as recited in claim 1 further comprising means for preventing sliding movement of said slide tracks with respect to said slide mechanisms until said slide mechanisms are substantially in said initial open position.

5. A boat as recited in claim 1 wherein said opening comprises a door opening, and wherein said closure comprises a door having a top, a center portion, and a bottom; and wherein said first slide mechanism is mounted adjacent said closure bottom and said deck, and wherein said second slide mechanism is mounted at said center portion of said door and spaced widely from said top of said door.

6. A boat as recited in claim 1 wherein said at least one lever for mounting said first slide mechanism comprises first and second pivoted levers each having a first and second end and a center portion, each of said first and second pivoted levers operatively pivotally connected at said first and second ends thereof, respectively, to said deck or cabin, and said slide mechanism; and a third lever pivotally connected to said center portions of said first and second levers.

7. A boat as recited in claim 2 wherein said means for substantially synchronizing rotation of said rotatable gears comprises a timing chain or belt operatively connected to said gears.

8. A boat as recited in claim 6 further comprising an interlock lever and an interlock mechanism plate, said interlock mechanism plate mounted to said first slide mechanism and having a movable interlock element mounted therein, a blocking element mounted to said interlock lever for engaging a recess in said closure, and a slot formed in said interlock lever to allow movement of said movable interlock element to allow pivoting of said interlock lever; said interlock lever, interlock mechanism plate, movable interlock element, and blocking element mounted with respect to each other so that when said third lever moves to said initial open position, said interlock lever is pivoted to a position allowing movement of said blocking element out of said blocking recess by sliding said closure, so that said closure is allowed to slide with respect to said slide mechanism.

9. A boat as recited in claim 8 wherein said interlock lever comprises a hook element, and wherein said third lever comprises a locking pin, said third lever, said interlock lever, and said interlock mechanism plate mounted with respect to each other so that when said interlock lever is moved to the position withdrawing said blocking element from said blocking recess, said hook element engages said locking pin so that said first, second and third levers are retained in said initial open position while said closure slides with respect to said slide mechanisms.

10. A boat as recited in claim 6 further comprising at least one lever for mounting said second slide mechanism for pivotal movement from said closed position to said initial open position; and further comprising a torsion tube or bar connecting said at least one lever of said second slide mechanism with said first lever for mounting said first slide mechanism so that said at least one lever of said second slide mechanism and said first lever of said first slide mechanism pivot together.

11. A self-contained closure and closure frame assembly comprising:

a closure frame having top and bottom frame elements and first and second side frame elements, said top, bottom, and side frame elements defining a closure opening; and a closure mounted to said closure frame and closing said closure opening in a closed position, said closure mounted to said closure frame for movement to a first initial open position in which said closure is spaced outwardly from said closure frame and substantially parallel thereto, and then to a final open position in which said closure is substantially clear of said opening as a result of sliding movement between said closure and said closure frame;

said closure and closure frame comprising a self-contained integral assembly.

12. An assembly as recited in claim 11 wherein said closure includes first and second slide tracks therein; and wherein said closure is mounted to said closure frame by first and second slide mechanisms for cooperating with said first and second slide tracks, and at least one lever connecting each of said slide mechanisms to said closure frame so that said closure moves from said closed position to said initial open position as said levers pivot.

13. An assembly as recited in claim 12 wherein each of said slide tracks comprises a linear gear, and wherein each of said slide mechanisms comprises a rotatable gear engaging a respective linear gear; and further comprising means for substantially synchronizing rotation of said rotatable gears to substantially preclude vertical skewing of said closure during sliding movement thereof.

14. An assembly as recited in claim 13 wherein each of said slide mechanisms further comprises a low friction material slide block sliding in one of said slide tracks, and having a key or keyway, and a slide block bracket having a keyway or key cooperating with said slide block key or keyway, to substantially prevent horizontal skewing of said closure.

15. An assembly as recited in claim 12 further comprising means for preventing sliding movement of said slide tracks with respect to said slide mechanisms until said slide mechanisms are substantially in said initial open position.

16. An assembly as recited in claim 12 wherein said at least one lever for mounting said first slide mechanism comprises first and second pivoted levers each having a first and second end and a center portion, each of said first and second pivoted levers operatively pivotally connected at said first and second ends thereof, respectively, to said deck or cabin, and said slide mechanism; and a third lever pivotally connected to said center portions of said first and second levers.

17. An assembly as recited in claim 13 wherein said means for substantially synchronizing rotation of said rotatable gears comprises a timing chain or belt operatively connected to said gears, said chain or belt disposed in a first torsion tube.

18. An assembly as recited in claim 16 further comprising an interlock lever and an interlock mechanism plate, said interlock mechanism plate mounted to said first slide mechanism and having a movable interlock element mounted therein, a blocking element mounted to said interlock lever for engaging a recess in said closure, and a slot formed in said interlock lever to allow movement of said movable interlock element to allow pivoting of said interlock lever; said interlock lever, interlock mechanism plate, movable interlock element, and blocking element mounted with respect to each other so that when said third lever moves to said initial open position, said interlock lever is pivoted to a position allowing movement of said blocking element out of said blocking recess by sliding said closure, so that said closure is allowed to slide with respect to said slide mechanism.

19. An assembly as recited in claim 18 wherein said interlock lever comprises a hook element, and wherein said third lever comprises a locking pin, said third lever, said interlock lever, and said interlock mechanism plate mounted with respect to each other so that when said interlock lever is moved to the position withdrawing said blocking element from said blocking recess, said hook element engages said locking pin so that said first, second and third levers are retained in said initial open position while said closure slides with respect to said slide mechanisms.

20. An assembly as recited in claim 16 further comprising at least one lever for mounting said second slide mechanism for pivotal movement from said closed position to said initial opened position; and further comprising a second torsion tube or bar connecting said at least one lever of said second slide mechanism with said first lever for mounting said first slide mechanism so that said at least one lever of said second slide mechanism and said first lever of said first slide mechanism pivot together.

21. A mounting assembly for mounting a closure to a frame comprising:

a first lever assembly comprising first and second levers each having a first and second end and a center portion, a third lever having first and second ends, and first and second mounting elements, said first and second levers each pivotally mounted at said first end thereof to said first frame element, and pivotally mounted at said second ends thereof to said second mounting element, and said third lever pivotally connected at said first and second ends thereof to said center portions of said first and second levers, respectively, to insure movement of said first and second levers together;

a second lever assembly comprising a fourth lever having first and second ends, said fourth lever pivotally mounted at said first end thereof to a third mounting element, and pivotally mounted at said second end thereof to a fourth mounting element;

said second and fourth mounting elements operatively connected to a closure and said first and third mounting elements operatively connected to a frame; and a torsion tube or bar connecting said first and fourth levers together so that said first and fourth levers pivot together about said first ends thereof.

22. An assembly as recited in claim 21 wherein said first mounting element comprising an interlock mechanism plate; and further comprising an interlock lever pivotally connected to said interlock mechanism plate.

23. An assembly as recited in claim 22 wherein said interlock mechanism plate mounts a movable interlock element positioned to be engaged by said third lever; and wherein said interlock lever comprises a cam slot and a blocking element, said interlock lever and said interlock mechanism plate and said third lever being mounted with respect to each other so that when said third lever moves said movable interlock element said movable interlock element engages said cam slot to allowing pivoting of said interlock lever so that said blocking element thereof is movable from a position operatively substantially blocking movement of said closure to a position not blocking movement of said closure.

24. An assembly as recited in claim 23 wherein said interlock lever further comprises a hook element, and wherein said third lever has a locking pin extending upwardly therefrom adjacent but spaced from said first end thereof; and wherein said hook element and third lever are positioned with respect to each other so that when said blocking element is moved out of blocking engagement with said closure, said hook element engages said locking pin to lock said third lever in place.

25. An assembly as recited in claim 21 wherein said closure and said second and fourth mounting elements are slidable with respect to each other.

26. An assembly as recited in claim 25 wherein said closure includes first and second slide tracks therein, and wherein said second and fourth mounting elements are connected to first and second slide mechanisms, respectively, for cooperating, respectively, with said first and second slide tracks.

27. An assembly as recited in claim 26 wherein each of said slide tracks comprises a linear gear, and wherein each of said slide mechanisms comprises a rotatable gear engaging a respective linear gear; and further comprising means for substantially synchronizing rotation of said rotatable gears to substantially preclude vertical skewing of said closure during sliding movement thereof.

28. An assembly as recited in claim 26 wherein each of said slide mechanisms further comprises a low friction material slide block sliding in one of said slide tracks, and having a key or keyway, and a slide block bracket having a keyway or key cooperating with said slide block key or keyway, to substantially prevent horizontal skewing of said closure.

29. An assembly as recited in claim 27 wherein said means for substantially synchronizing rotation of said rotatable gears comprises a timing chain or belt operatively connected to said gears.

30. An assembly as recited in claim 23 wherein said interlock mechanism plate includes a blocking element receiving recess into which said blocking element moves when said interlock lever is pivoted to move said blocking element to a non-blocking position with respect to said closure.

31. An assembly as recited in claim 23 wherein said movable interlock element comprises a first spring pressed element disposed within a passage in said interlock mechanism plate, and a second roller portion engaging said cam slot in said interlock lever; and wherein said interlock mechanism plate includes a slot therein in which a connection between said spring pressed interlock element and said roller slides during movement thereof.

32. A closure and closure frame assembly comprising:

a closure frame having top and bottom frame elements and first and second side frame elements, said top, bottom, and side frame elements defining a closure opening; and a closure mounted to said closure frame and closing said closure opening in a closed position, said closure mounted to said closure frame for movement to a first initial open position in which said closure is spaced outwardly from said closure frame and substantially parallel thereto, and then to a final open position in which said closure is substantially clear of said opening as a result of sliding movement between said closure and said closure frame;

wherein said closure includes first and second slide tracks therein; and wherein said closure is mounted to said closure frame by first and second slide mechanisms for cooperating with said first and second slide tracks, and at least one lever connecting each of said slide mechanisms to said closure frame so that said closure moves from said closed position to said initial open position as said levers pivot.

33. An assembly as recited in claim 32 wherein each of said slide tracks comprises a linear gear, and wherein each of said slide mechanisms comprises a rotatable gear engaging a respective linear gear; and further comprising means for substantially synchronizing rotation of said rotatable gears to substantially preclude vertical skewing of said closure during sliding movement thereof.

34. An assembly as recited in claim 33 wherein each of said slide mechanisms further comprises a low friction material slide block sliding in one of said slide tracks, and having a key or keyway, and a slide block bracket having a keyway or key cooperating with said slide block key or keyway, to substantially prevent horizontal skewing of said closure.

35. An assembly as recited in claim 32 wherein said at least one lever for mounting said first slide mechanism comprises first and second pivoted levers each having a first and second end and a center portion, each of said first and second pivoted levers operatively pivotally connected at said first and second ends thereof, respectively, to said deck or cabin, and said slide mechanism; and a third lever pivotally connected to said center portions of said first and second levers.

36. An assembly as recited in claim 35 further comprising an interlock lever and an interlock mechanism plate, said interlock mechanism plate mounted to said first slide mechanism and having a movable interlock element mounted therein, a blocking element mounted to said interlock lever for engaging a recess in said closure, and a slot formed in said interlock lever to allow movement of said movable interlock element to allow pivoting of said interlock lever; said interlock lever, interlock mechanism plate, movable interlock element, and blocking element mounted with respect to each other so that when said third lever moves to said initial open position, said interlock lever is pivoted to a position allowing movement of said blocking element out of said blocking recess by sliding said closure, so that said closure is allowed to slide with respect to said slide mechanism.

37. An assembly as recited in claim 36 wherein said interlock lever comprises a hook element, and wherein said third lever comprises a locking pin, said third lever, said interlock lever, and said interlock mechanism plate mounted with respect to each other so that when said interlock lever is moved to the position withdrawing said blocking element from said blocking recess, said hook element engages said locking pin so that said first, second and third levers are retained in said initial open position while said closure slides with respect to said slide mechanisms.

38. An assembly as recited in claim 35 further comprising at least one lever for mounting said second slide mechanism for pivotal movement from said closed position to said initial opened position; and further comprising a second torsion tube or bar connecting said at least one lever of said second slide mechanism with said first lever for mounting said first slide mechanism so that said at least one lever of said second slide mechanism and said first lever of said first slide mechanism pivot together.

* * * * *